US006003683A

United States Patent [19]

McCarthy

[11] Patent Number: 6,003,683

[45] Date of Patent: Dec. 21, 1999

[54] FORWARD OR REVERSE HYDROCYCLONE SYSTEMS AND METHODS

[75] Inventor: Christopher E. McCarthy, Middletown, Ohio

[73] Assignee: Thermo Black Clawson Inc., Middletown, Ohio

[21] Appl. No.: 09/011,032

[22] PCT Filed: Jun. 20, 1996

[86] PCT No.: PCT/US96/10679

§ 371 Date: Feb. 2, 1998

§ 102(e) Date: Feb. 2, 1998

[87] PCT Pub. No.: WO97/05957

PCT Pub. Date: Jul. 20, 1997

[51] Int. Cl.[6] ..... B04C 5/00

[52] U.S. Cl. ..... 209/727; 209/729; 210/512.2; 162/55

[58] Field of Search ..... 209/727, 728, 209/729, 730; 210/512.2, 806, 512.1; 162/55, 4

[56] References Cited

U.S. PATENT DOCUMENTS

| | | | |
|---|---|---|---|
| 3,486,619 | 12/1969 | Grundelius et al. | 209/727 X |
| 3,849,245 | 11/1974 | Marsh et al. | 162/4 |
| 3,912,579 | 10/1975 | Braun | 162/4 |
| 4,155,839 | 5/1979 | Seifert et al. | 209/727 X |
| 4,927,536 | 5/1990 | Wanell et al. | 210/512.2 |

FOREIGN PATENT DOCUMENTS

| | | | |
|---|---|---|---|
| 1105848 | 7/1981 | Canada . | |
| 3722440 | 1/1988 | Germany | 209/729 |

OTHER PUBLICATIONS

"Bergstrom finds "reverse cleaning" answer to lightweight contaminants"by James Clay, Aug. 15, 1980, pp. 28–30.

Bliss, Terry, "Thought–Flow Cleaners Offer Good Efficientcy with Low Pressure Drop" Pulp & Paper. pp. 2–6, Mar. 1985.

*Primary Examiner*—Tuan N. Nguyen

*Attorney, Agent, or Firm*—Biebel & French

[57] ABSTRACT

Hydrocyclone cleaning systems and methods remove contaminants from a suspension of papermaking stock. A subsystem 10 employs forward cleaners for removing heavy contaminants while a subsystem 12 is fed directly from subsystem 10 and removes lightweight contaminants. The subsystem 12 also includes a through-flow cleaner which receives the rejects flow from a primary reverse flow cleaner and both systems are connected to a common surge tank arrangement. Both subsystems operate at low consistencies or high efficiency while the primary through-flow cleaner of subsystem 12 provides a system output having a consistency approximately twice as high as that of the input so that the overall operation operates both as a stock cleaner and a stock thickener.

7 Claims, 1 Drawing Sheet

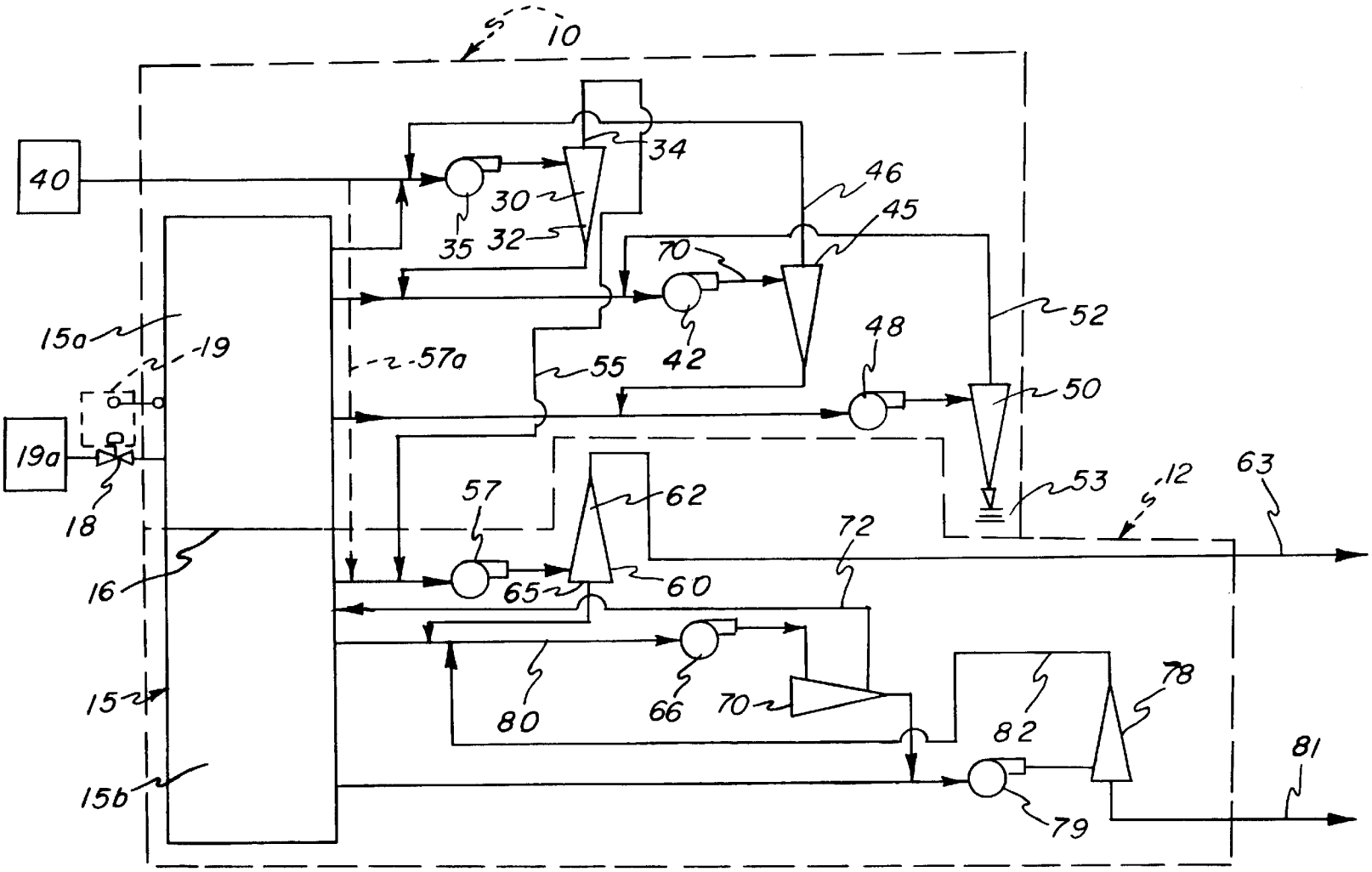
10
12
15
15a
15b
16
18
19
19a
30
32
34
35
40
42
45
46
48
50
52
53
55
57
57a
60
62
63
65
66
70
72
78
79
80
81
82

FORWARD OR REVERSE HYDROCYCLONE SYSTEMS AND METHODS

BACKGROUND OF THE INVENTION

This invention relates to systems and methods of using of hydrocyclone cleaners for cleaning and thickening a suspension of papermakers' fibers, otherwise commonly known as papermakers' stock. The methods and systems include a forward hydrocyclone cleaning subsystem followed by a reverse hydrocyclone cleaning subsystem. In each cleaner a feed flow is divided into at least one accepts and one rejects stream.

The terms "forward cleaning" and "reverse cleaning" have become well understood in the art of cleaning papermakers' stock, and relate to the manner in which a cyclone-type centrifugal cleaner is operated. Examples of cyclone-type cleaners connected and used as forward cleaners, in which an accept flow is removed at the base of the cone while a rejects flow is removed from the apex, are shown in Samson et al, U.S. Pat. No. 2,377,524 issued Jun. 5, 1945 and Grundelius et al, U.S. Pat. No. 3,486,619 issued Dec. 30, 1969. In a reverse cleaner system, a cyclone-type cleaner is operated in such a manner that the accept flow is removed from the apex of the cone, while the lighter rejects flow is taken out at the base, as shown in Braun, U.S. Pat. No. 3,912,579 issued Oct. 14, 1975, and in Braun et al, U.S. Pat. No. 3,557,956 issued Jan. 26, 1971.

Forward hydrocyclone cleaning systems are commonly employed to remove heavy particles and contaminants, while hydrocyclone reverse cleaning systems are utilized to remove lightweight contaminants. It is generally known that lower feed consistency leads to better contaminant removal efficiency, in both forward and reverse cleaners. In many installations, the stock preparation equipment includes both forward and reverse cyclone-type cleaners or cleaning systems at discrete locations within the system to produce the particular result for which the cleaning system is efficient. However, there remains a need for combining the forward and reverse cleaners into a single integrated cleaning system, in which the inherent operation characteristics of each system is used to enhance the efficiency of the other.

The prior art also knows so-called "through-flow" cleaners, with a feed port at the base of a cone, and the accepts and rejects outlets at the cone apex. Such a cleaner is described in an article entitled "Through-flow Cleaners Offer Good Efficiency with Low Pressure Drop", Pull & Paper, March 1985 by Terry Bliss. This article also gives a convenient schematic comparison of the through-flow cleaner with the conventional forward and reverse cleaners.

A conventional system for reverse cleaners would include a cascade arrangement, whereby rejects from a first stage are recleaned in a second stage. Secondary accepts join the primary feed, while secondary rejects go to the third stage. Tertiary accepts join the secondary feed and tertiary rejects might leave the system, or go to quaternary stage in the same fashion as described above. Such a system has a high efficiency, but the volume to be pumped through first, second and third stages is very high, and correspondingly the electrical pumping power required is also high. Due to the relatively low reject flow from the entire system, the accepts consistency from the primary cleaner approximately equals the feed consistency, i. e., there is no appreciable thickening or a dilution effect.

A modification of the basic cascade system is shown in FIG. 4 of the Bliss article, giving a somewhat lower power requirement for the system.

Today, conventional through-flow cleaners are used often, because of their low inlet pressure requirement and a low reject rate. The latter results in a small secondary system. Consequently, capital and electrical power requirements are low. Such a system is shown in the Bliss article, FIG. 6. Unfortunately, cleaning efficiency is low, in comparison with that of reverse cleaners, and to compensate, it is today's common practice to use series connected primary through-flow cleaners, i.e., clean the pulp twice. Systems accepts consistency would be about the same as the feed consistency.

Also, combinations of primary reverse cleaners, and secondary through-flow cleaners have been used, as shown in FIG. 5 of the Bliss article. Significantly, secondary accepts are recycled to the primary feed port in conventional cascade fashion. The data in FIG. 5 permit the calculation of the input, consistency, tonnage, and flow rate of the pulp fed to this cleaning system, i.e., the line marked "stock". Accordingly, feed tonnage=150 T/D Feed flow rate=maximum 1645 gpm (assuming "0" flow from the white water tank); therefore:

Feed consistency=minimum 1.6% (again assuming "0" flow from the white water tank).

Therefore, very little stock thickening is achieved. Also, some white water flow would normally be permitted, raising the feed stock consistency required even higher.

Obviously, no significant thickening is taking place in this system and the flow rate through the primary reverse cleaner and therefore also the electrical power requirement for that stage is quite high.

SUMMARY OF THE INVENTION

In the broadest sense, the invention is a cleaning system consisting of a reverse primary cleaner stage and a through-flow cleaner secondary stage. The accepts flow from the second stage is used in a heretofore unknown way. The invention recognizes the particular quality of the secondary accepts flow, i.e., its very low consistency, and excellent cleanliness. In other words, the water is so lean and so clean that it can be used as upstream dilution, in the same fashion as conventionally, a decker filtrate is used. Remarkably, the system delivers a higher consistency primary accepts stream as an output, in comparison with the consistency of the feed. The flow rate to the primary reverse cleaner and consequently the electrical power requirement are comparatively lower. Therefor the system of this invention operates both as a stock cleaner and as a stock thickener.

Another aspect of this invention employs forward and reverse cyclones in a common integrated system, having commonly-connected surge chests, in which the stock to be cleaned is presented to a forward cleaning subsystem and then directly to a reverse cleaning subsystem. The first stage of the forward subsystem employs forward-connected cyclones. The accepts flow from the first stage of the forward cleaning subsystem is sent directly to the inlet of the pump for the primary cyclone in the reverse cleaning subsystem. The primary reverse cyclone has outlets sized to provide a high hydraulic reject rate of about 35% or more. The accepts flow from the primary reverse cyclone is delivered directly out of the system for further handling or processing by downstream equipment.

The rejects flow from the primary cyclone in the forward cleaning subsystem is processed by a second cyclone and optionally a tertiary or further cyclone connected in cascade fashion, with each of the cyclone stages being connected to receive make-up fluid from a surge chest.

The rejects flow from the primary reverse flow cyclone is of a very low consistency and is processed in a low loss loop which includes a low hydraulic split (low reject rate) through-flow cyclone cleaner, in which a major portion of the accepts flow is collected and returned directly to a surge chest. The small proportion of rejects from the through-flow cleaner may optionally be processed through a tertiary reverse cleaner or simply leave the system.

The surge chests for each of the subsystems may be connected in common so that the overflow from the surge chest of the reverse cleaner subsystem flows into the surge chest for diluting the forward cleaner subsystem. A suitable control system may include the level of white water liquid in the forward surge chest being maintained at a given level by make-up water taken from an external white water loop, in order to maintain and control the dilution or consistency, by use of a level control valve. Both the forward cleaning and the reverse cleaning subsystems operate at low input consistencies, to maintain high efficiency of separation in the respective cyclones, while the accepts output from the reverse cleaner system is presented to the downstream equipment at a consistency of approximately twice as high as that of the input to the forward cyclone cleaning system.

By utilizing the inherent ability of a reverse cleaner to thicken a stock suspension, it is possible to present a cleaned stock suspension for downstream processing at a consistency at least 1.5 to 2 times inlet consistency, thereby achieving an approximate 100% increase in consistency, equal to a 50% decrease in water content. A high consistency output has many advantages for the user. For example, if the system of this invention is placed downstream from the fine screens, the subsequent dewatering device can be sized much smaller, and at a substantial cost savings.

If a system according to this invention is placed upstream of the fine screens, its high forward cleaning efficiency by removal of the smaller abrasive materials, reduces wear and thus permits the contoured shape fine screens to last longer. Thickening costs are reduced because the stream from the fine screens is at a higher-than-conventional consistency.

The cleaner system of this invention itself is capable of operating at very high efficiency. Since the primary forward cleaner is operated at low consistency, it inherently operates at high efficiency, and delivers a still lower consistency stock through its base accepts outlet to the primary reverse flow cleaner. Therefore, a lower consistency stock is applied to the primary reverse flow cyclone which improves its efficiency as well, even at relatively low separating temperatures of 90° F. or less. The inlet consistency is maintained by the reuse of the dilution water from the surge chest which collects the clean, low consistency accepts stream of the secondary through-flow cleaner. The unit also takes advantage of the natural thickening effect of the primary reverse cleaner, not only to provide high consistency accepts, but also to provide a low consistency feed directly to the through-flow cleaner.

In one aspect of the invention, lightweight undesirable components are removed from a stock suspension of papermaking stock with a method including the steps of feeding the stock suspension to a primary stage of a reverse cleaner and removing from the reverse cleaner and accepts flow at a volumetric rate of about 30–65% of the in flow rate and removing a rejects flow from the reverse cleaner, feeding the rejects flow to the inlet of a through-flow cleaner, removing the accepts flow from the through-flow cleaner and using it for dilution upstream of the primary stage, and removing the rejects flow of the through-flow cleaner for further treatment. In a further aspect, the accepts flow of the through-flow cleaner is delivered to a surge tank in the dilution step.

In another aspect of the invention, a hydrocyclone type cleaning system for cleaning a papermaking stock from a source of such stock includes a reverse cyclone cleaner with an inlet at the base of a conical shape, an accepts outlet at the apex and a rejects outlet at the base and having a hydraulic reject rate of about 35% or higher, means applying stock suspension from the source to the reverse cyclone cleaner inlet, means for delivering an accepts flow from the reverse cyclone cleaner as the outlet of the system, a through-flow type cyclone cleaner having an inlet, a rejects outlet at the base, and an accepts outlet at the base, has a hydraulic reject rate of about 10% or less, means applying the rejects flow from the reverse cyclone cleaner rejects outlet to the through-flow cleaner inlet, means applying a flow from the through-flow cleaner accepts outlet for upstream dilution of the stock suspension source, means delivering the liquid flow from the through-flow cleaner rejects outlet for processing or disposal, while the liquid delivered from the accepts outlet of the reverse cyclone cleaner forms an outlet for the system having a consistency which substantially exceeds the consistency of the stock source and which is substantially free of lightweight contaminants.

It is accordingly an important object of this invention to provide a cyclone type cleaner system and method for a suspension of papermaker's fibers in which cleaning is accomplished at high efficiency, but with relatively low specific power input, providing an output having a consistency substantially higher than the input, and making possible a reduction in the size and cost of downstream equipment required for further processing of the stock suspension.

A further object of the invention is the provision of a cyclone cleaning system for papermakers' stock which has a forward cleaning subsection directly feeding a reverse cleaner subsection, and in which the subsections sharing a common surge chest.

A still further object of the invention is the provision of a system and method of using of cyclone cleaners, for cleaning a stock suspension of papermaker's fibers employing a forward cleaning subsystem in which the accepts are delivered directly from a primary forward cleaner to the input pump of a primary reverse cleaner in a reverse cleaner subsystem, and in which the reverse cleaner subsystem has a rejects cleaning loop employing a secondary cleaner in the form of a through-flow cleaner that operates at low consistency, high efficiency and which has a low hydraulic reject rate. Efficiencies of primary reverse and secondary through-flow cleaners should be matched to prevent build-up of contaminants in the loop.

A further object of the invention is the provision of a cyclone type cleaning system for paper stock that takes optimum advantage of the inherent differences between forward cleaning and reverse or lightweight removal cleaning, and optimizes each of these cleaner mechanisms for maximum efficiency and for providing, simultaneously, an output of substantially higher consistency than the input.

These and other objects and advantages of the invention will be apparent from the following description, the accompanying drawings and the appended claims.

BRIEF DESCRIPTION OF DRAWING

The drawing is a flow diagram of illustrating the system and the methods of practicing the inventions.

DESCRIPTION OF THE PREFERRED EMBODIMENT

The cleaning system is illustrated in the drawing as including a forward cleaning subsystem 10 that is directly connected to a reverse cleaning subsystem 12, and having a surge chest 15 common to each of the subsystems 10 and 12. The surge chest 15 may be split or divided into two sections, namely a section 15*a,* principally associated with the forward-cleaning subsection 10 and a section 15*b* associated with the subsection 12, connected to each other by a common overflow dam or weir 16 by which the flow of white water from the reverse cleaning chest section 15*b* is provided, in a controlled manner, to the forward cleaning chest section 15*a*. Make-up water to the surge chest 15 is controlled by a level controller valve 18 responsive to a level control 19 from a source 19*a* of system white water.

System subsections 10 and 12 cooperate together to form novel apparatus for a cleaning system and practice a novel method in which both heavy and light contaminants are removed from paper making stock. Subsection 12, however, may be operated independently of or in the absence of subsection 10 simply by feeding a source of low consistency stock into the inlet portion (at pump 57) to subsection 12. It's novel concept consists of a reverse cleaning system which uses primary cleaners at a very low inlet consistency which stock may be laden with light contaminants. The reject flow from a reverse cleaner is directed to a through-flow cleaner, the accepts flow from which is recognized as clean and low in consistency, comparable to a normal decker filtrate. Such accepts may therefore be combined with decker filtrate or used independently for upstream dilution. Both subsystems 10 and 12 operate at relatively low power requirements. This is particularly true since the secondary cleaning accepts do not need to be recleaned, and a smaller downstream system thickener may be employed by reason of the higher consistency of the primary accepts output.

The forward-cleaning subsection 10 includes a primary cyclone 30 of conventional construction. The cyclone inlet is supplied by a conventional pump 35 which is connected to a source 40 of a dilute stock furnish or suspension of papermaker's stock for cleaning and removal of undesirable heavy and light components. Make-up liquid, for proper dilution, is conventionally applied to the inlet of the pump 30, from the forward chest section 15*a*, as shown. The forward cleaning cyclone of the kind used for cyclone 30 may comprise the "ULTRA-CLONE" cleaner of the Shartle-Pandia Division, The Black Clawson Company, Middletown, Ohio. Other examples may be found in Pesch, U.S. Pat. No. 3,085,927, and Malm, U.S. Pat. No. 3,352,745.

The heavy rejects from the primary forward cleaner 30 are delivered through the apex 32 to the inlet of a further delivery pump 42, corresponding to the pump 35, to the inlet of a secondary forward cleaner 45, and the accepts from the cleaner 45 are delivered back on a line 46 to the inlet of the pump 35 for the cleaner 30 while the heavy rejects are delivered through the apex to a pump 48 to an optional tertiary forward cleaner 50, whose accepts are delivered back on a line 52 to the inlet of the pump 42. The heavy rejects of the cleaner 50 are delivered conventionally to waste 53, such as landfill or drain.

The secondary forward cleaner 45 and optional tertiary forward cleaner 50, in the subsystem 10, are connected in conventional cascade manner as known in the art, and as described in connection with FIG. 2 of Grundelius et al, U.S. Pat. No. 3,486,619. Each should have a relatively low hydraulic reject rate, such as 20% or less.

Important for an understanding of one aspect of invention is the fact that the accepts from the primary forward cleaner 30 are taken from the base accepts outlet 34 and delivered directly to the input pump 57 of the reverse cleaner subsection 12 on line 55. At this point, it is helpful to note that it is preferred to operate the forward feed subsection 10 at relatively low consistency, as supplied by the pump 35. It is preferred that the inlet consistency to the cleaner 30 be at about 0.7% to 1.2%, and this low consistency is maintained by a blending of volume from the source 40 and from the forward surge chest 15. It is also important to recognize that the input to the subsystem 12 is of yet lower consistency, inherently, due to the operation of the cleaner 30. Thus, the cleaned stock on line 55, from which the heavy contaminants have been removed, will have a consistency of approximately 0.1% lower than that of the input or source. Therefore, if the input from source 40 is between 0.6% and 1.1%, then the feed to the subsystem 12 will be approximately 0.5% to 0.8% consistency.

In those instances where the particular cleaning function of subsystem 10 is not required, such as where heavy contaminants are not present in any substantial quantity or are otherwise taken care of, the stock may be supplied from the source 40 directly to the pump 57 forming the inlet to subsystem 12, such as through alternative line 57*a*.

The outlet from the primary forward cleaner 30 is directed through line 55 to the inlet of a pump 57 to the inlet of the primary reverse cleaner 60. The cleaner 60 may consist of a "CONTRA-CLONE" cleaner of the Shartle-Pandia Division, The Black Clawson Company, 605 Clark Street, Middletown, Ohio 45042, and as shown in U.S. Pat. No. of Seifert et al 4,155,839. For the purpose of this invention, it is a cleaner with a high hydraulic reject rate of approximately 35% or greater. As previously noted, it is operated at relatively low consistency and therefore at a level of high efficiency. For highest efficiency, however, it is preferred to use the extended dwell reverse hydrocyclone cleaner as described in the copending application of McCarthy Ser. No. 60/002,177 filed Aug. 11, 1995, the disclosure of which is incorporated herein by reference.

The accepts flow from the cleaner 60 is delivered through the apex 62 on a line 63 out of the system for downstream processing. Since the cleaner 30 may have a hydraulic reject rate of approximately 50%, the accepts flow on the outlet line 63 had a consistency of about twice that of the input consistency, either at source 40 or pump 57. Therefore, in the example given, if the input consistency is between 0.5% and 1.0%, the outlet will be respectively between about 1.0% and 1.6%. This means that about one-half of the liquid content has been removed. At the same time, the undesirable heavy and lightweight contaminants have been removed, the lightweight contaminants having been removed through the base or reject outlet 65 for further processing in the subsystem 12.

Another important feature of subsystem 12 is the manner in which the high volume of reject liquid is continuously handled. The reject liquid, which will have a very low consistency, but relatively high volume, is delivered from the rejects outlet 65 to a pump 66 to the inlet of a through-flow cleaner 70 having a relatively low hydraulic reject rate in the order of about 5% to 10%.

The cleaner 70 may be an X-CLONE™ model also supplied by Shartle-Pandia Division, above, and made according to U.S. Patent of Bliss No. 4,564,443. This cleaner is particularly noted for its ability to provide a concentration of light contaminants when operating in very low consistency stock suspensions, and is further noted for its low pressure drop. The through-flow cleaner 70 is illustrated as in a loop with its accepts line 72 leading directly back to the surge tank section 15*b*. Due to its high efficiency, a major portion of the input is cleaned and returned while a small portion, in the order of 5% to 10%, may be delivered directly out of the system or, optionally, delivered to a tertiary reverse cleaner 78 by a pump 79. The cleaner 78 may be a duplicate of the cleaner 60 with its reject line 81 containing extremely light contaminants being delivered out of the system for disposal, while its accepts line 82 leading from its apex is returned to the inlet line 80 to the pump 66 for the through-flow cleaner 70. Makeup liquid volume is taken from chest 15*b* through line 80.

While the accepts flow from the through-flow cleaner 70 is shown as being returned directly to the chest 15*b*, the accepts is very low in consistency, and so clean as to be usable in the same manner as a normal decker filtrate is used. Therefore, the accepts flow is preferably returned in a loop to the chest 15 for upstream dilution or delivered elsewhere within the white water loop.

The advantage of the system of this invention is the fact that the cyclone cleaners of both subsystems are operated at high efficiency due to the low consistency inputs. A further advantage is that the overall system is compact, employing a common surge chest arrangement with the accepts flow which ultimately exits the system, exiting at about a 100% increase in consistency, thereby providing advantages in the cost of downstream stock preparation and handling equipment.

The inlet flow to the surge tank from the through-flow cleaner 70 is, as noted, at a very low consistency which in turn, maintains a low stock consistency in the surge chest. This liquid is used at the inlet of the primary forward cleaner 30 to maintain the consistency at a low point which results in high efficiency of the primary cleaner, while minimizing fiber in the reject stream.

In lieu of the tertiary cleaner 78, the rejects from the through flow cleaner 70 may be delivered to a conventional clarifier.

Since the dwell time of the liquid within the system is maximized, particularly by the use of the common surge tank, the rotating flow within the various cyclones is stabile and solids removal is therefore enhanced. The weir or dam 16 which separates the chest section 15*b* from the section 15*a* controls the flow into section 15*a* and assures that chest section 15*b* always has an adequate supply of stock for cleaners 60 and 70. Make-up liquid to the chest 15 is supplied from a source 19*a* of white water by the make-up controller 19, as demanded by the level control valve 18.

The method as practiced by this invention is particularly practical for removing lightweight undesirable components from a stock suspension of paper making stock which includes the steps of feeding the stock suspension to the primary stage of a reverse cleaner and removing an accepts flow from this primary stage at a volumetric rate of about 30% to 65% of the input, in which the accepts flow has a consistency which is about 30 to 60% higher than that of the input stock suspension. The rejects flow is directed to a through-flow cleaner stage in which the accepts of the through-flow cleaner stage has a low consistency and is used for an upstream dilution. The rejects flow of the through-flow cleaner is removed for further cleaning or processing. Thus, the method has the advantage of providing an increase in consistency while operating with high efficiency and low power requirements.

In another aspect of the invention the method practiced includes the steps of applying a low consistency stock, to be cleaned, to a forward cleaner, applying the accepts of the forward cleaner to a reverse cleaner having a high hydraulic reject rate and taking the accepts off of the reverse cleaner at a high consistency while delivering the rejects of the reverse cleaner to a loop-connected through-flow cleaner, in which the inlet consistency to the primary forward cleaner is about 1% or less, and the inlet consistency to the primary reverse cleaner is at a consistency lower than that applied to the forward cleaner.

The new concept for a reverse cleaning system uses primary cleaners where rejects flow is at very low consistency and laden with light contaminants. This flow is directed to the through-flow reverse cleaner 70, the accepts flow of which is recognized to be as clean and as low in consistency as is abnormal decker filtrate. These accepts can therefore be mixed with a decker filtrate, or used independently for upstream dilution. This system design yields a high accepts consistency from the primary reverse cleaner 60, and thereby reduces the capacity requirement for the subsequent thickener or decker, electrical pumping power, and capital investment.

The new system provides high cleaning efficiency of a reverse cleaner and relatively low power requirement since secondary cleaner accepts need not be recleaned, and a smaller system thickener may be used because the primary accepts consistency is relatively high.

While the methods herein described, and the forms of apparatus for carrying this method into effect, constitute preferred embodiments of this invention, it, is to be understood that the invention is not limited to these precise methods and forms of apparatus, and that changes may be made in either without departing from the scope of the invention, which is defined in the appended claims.

I claim:

1. A method of thickening and removing lightweight undesirable components from a stock suspension of paper-making stock, comprising the steps of:

in a primary stage feeding the stock suspension to the inlet of a reverse hydrocyclone cleaner and from said reverse cleaner forming an accepts flow and a rejects flow, removing said accepts flow from said primary stage at a volumetric rate of about 30–65% of the inlet flows thereby thickening said suspension, directing said rejects flow to the inlet of a hydrocyclone through-flow flow cleaner and from said through-flow cleaner forming through-flow accepts and through-flow rejects, removing the accepts of the through-flow cleaner and delivering it for dilution of said stock suspension; and removing the rejects of the through-flow cleaner for further treatment.

2. The method of claim 1 further comprising the step of delivering the accepts of the through-flow cleaner to a surge tank for application from such tank as dilution to the stock suspension.

3. A method of thickening and removing lightweight undesirable components from a stock suspension of paper-making stock, comprising the steps of:

applying the stock suspension at an input consistency of about 1.0% or less to the inlet of a reverse cyclone-type cleaner having a hydraulic rejects rate of at least about 35%, separating in said reverse cyclone-type cleaner the light-weight undesirable components in a reject fraction at low consistency from an accepts fraction at a consistency which substantially exceeds said input consistency, delivering said accepts fraction for further processing, delivering said reject fraction to the inlet of a through-flow cyclone cleaner having a hydraulic reject rate of about 10%, returning the accepts from the through-flow cleaner to a surge tank connected in common with said cleaners, and delivering the rejects from said through-flow cyclone cleaner for further processing or disposal.

4. A method of removing heavy and light undesirable components from a stock suspension of papermaking stock, comprising the steps of:

applying the stock suspension at an input consistency of about 1.1% or less to the inlet of a cyclone-type forward cleaner for removing said heavy undesirable components, applying the accept from said cyclone-type forward cleaner at a consistency lower than said input consistency, to the inlet of a reverse cyclone-type cleaner having a hydraulic rejects rate of at least about 35%, removing in said reverse cyclone-type cleaner the light undesirable components in a reject fraction at low consistency, and removing an accepts fraction free of said undesirable components at a consistency which substantially exceeds said input consistency, delivering said reject fraction from the reverse cyclone-type cleaner to the inlet of a through-flow cyclone cleaner having a hydraulic reject rate of about 10%, delivering the accepts from the through-flow cyclone-type cleaner as dilution to said stock suspension, and delivering the rejects from said through-flow cyclone cleaner for further processing or disposal.

5. The method of claim 4 in which the step of delivering the accepts from the through-flow cyclone cleaner as dilution includes the step of supplying said accepts to a surge tank connected in common with the reverse cyclone-type cleaner and the cyclone-type forward cleaner.

6. A system for removing lightweight contaminants from a suspension of paper-making stock comprising a source of such stock at a given consistency, a reverse cyclone cleaner having a generally conical shape and having and inlet at the base thereof, an accepts outlet at the apex thereof, and a rejects outlet at the base thereof, said reverse cyclone cleaner having a hydraulic reject rate of about 35% or greater, means for applying said source to said reverse cyclone cleaner inlet, a through-flow cyclone cleaner having an inlet, a rejects outlet at the base thereof, and an accepts outlet at the base thereof, and having a hydraulic rejection rate of about 10% or less, means applying the rejects from said reverse cyclone cleaner rejects outlet to said through-flow cleaner inlet, means applying the liquid from said through-flow cleaner accepts outlet for upstream dilution of said stock suspension source, means delivering the liquid form said through-flow cleaner rejects outlet for processing or disposal, and means delivering liquid from the accents outlet of said reverse cyclone cleaner as the system outlet with a consistency which substantially exceeds said given consistency and which is substantially free of said lightweight contaminants.

7. A system of cyclone type cleaners for removing heavy and light undesirable fractions from a stock suspension of papermakers stock and for delivering a clean suspension which has a consistency substantially higher than the consistency of said stock suspension, comprising:

a source of said stock suspension including a surge chest of white water for dilution thereby providing an inlet supply of dilute stock suspension having a consistency of about 1.5% or less, a forward cleaning subsystem having a primary forward cyclone cleaner and at least one secondary forward cyclone cleaner connected in cascade relation to said primary forward cyclone cleaner, means delivering said diluted stock suspension to said primary forward cyclone cleaner for removal of said heavy fraction therein, said primary forward cleaner having an accepts outlet for which it partially cleans stock suspension is delivered at a consistency less than said feed consistency, a reverse cleaner subsystem including a primary reverse cyclone cleaner having an accepts inlet, and accept outlet, and a rejects outlet, said reverse cyclone cleaner having a hydraulic reject rate of at least about 35%, a pump connected to convey said partially cleaned accepts from said primary forward cyclone cleaner to the inlet of said primary reverse cyclone cleaner, said reverse cleaner subsystem further having a through-flow cyclone type cleaner having a relatively low hydraulic rejects rate of about 10% or less, conduit and pump means connecting the rejects outlet of said primary reverse cyclone cleaner to the inlet of said through-flow cyclone type cleaner, a further conduit connecting accepts outlet of said through-flow cyclone-type cleaner to said surge chest, the accepts from said primary reverse flow cleaner being delivered for further processing at a consistency about 1.5 to 2 times that of diluted stock suspension and substantially free of said undesirable fractions, and means delivering the lightweight rejects from said through-flow cyclone cleaner for further processing or disposal.

* * * * *